US008952865B2

(12) United States Patent
Oh et al.

(10) Patent No.: US 8,952,865 B2
(45) Date of Patent: Feb. 10, 2015

(54) ANTENNA AND TRANSFORMER INCLUDED IN THE SAME

(75) Inventors: Gun-Seok Oh, Incheon (KR); Byung-Ho Kim, Seoul (KR)

(73) Assignee: ACE Technologies Corporation, Incheon-si (KR)

( * ) Notice: Subject to any disclaimer, the term of this patent is extended or adjusted under 35 U.S.C. 154(b) by 443 days.

(21) Appl. No.: 13/319,997

(22) PCT Filed: May 12, 2010

(86) PCT No.: PCT/KR2010/003007

§ 371 (c)(1), (2), (4) Date: Jan. 30, 2012

(87) PCT Pub. No.: WO2010/131904

PCT Pub. Date: Nov. 18, 2010

(65) Prior Publication Data

US 2012/0119976 A1 May 17, 2012

(30) Foreign Application Priority Data

May 12, 2009 (KR) ..... 10-2009-0041198

(51) Int. Cl.

| | |
|---|---|
| ***H01Q 1/00*** | (2006.01) |
| ***H01Q 3/00*** | (2006.01) |
| ***H01Q 3/01*** | (2006.01) |
| ***H01P 1/18*** | (2006.01) |
| ***H01Q 3/32*** | (2006.01) |
| ***H01Q 9/04*** | (2006.01) |
| ***H01Q 9/16*** | (2006.01) |
| ***H01Q 21/28*** | (2006.01) |

(52) U.S. Cl.

CPC ..... *H01Q 3/01* (2013.01); *H01P 1/184* (2013.01); *H01Q 3/32* (2013.01); *H01Q 9/0407* (2013.01); *H01Q 9/16* (2013.01); *H01Q 21/28* (2013.01)

USPC ..... 343/907; 343/766; 343/757

(58) Field of Classification Search

None

See application file for complete search history.

(56) References Cited

U.S. PATENT DOCUMENTS

| | | | | |
|---|---|---|---|---|
| 6,600,457 | B2 * | 7/2003 | Heinz et al. | 343/853 |
| 8,624,789 | B2 * | 1/2014 | Oh et al. | 343/757 |
| 2002/0149528 | A1 * | 10/2002 | Heinz et al. | 343/757 |
| 2006/0066494 | A1 * | 3/2006 | Trejtnar et al. | 343/757 |
| 2008/0198080 | A1 * | 8/2008 | Duan | 343/758 |
| 2012/0127060 | A1 * | 5/2012 | Oh et al. | 343/912 |

* cited by examiner

*Primary Examiner* — Trinh Dinh

(74) *Attorney, Agent, or Firm* — AlbertDhand LLP

(57) ABSTRACT

An antenna having a transformer exchangeable in accordance with tilting angle adjustment rate is disclosed. The antenna includes a phase shifter, a tilting adjustment apparatus and a transformer configured to move linearly in response to a force provided from the tilting adjustment apparatus, and deliver a force corresponding to the moving to the phase shifter.

6 Claims, 4 Drawing Sheets

(A)

(B)

ANTENNA AND TRANSFORMER INCLUDED IN THE SAME

TECHNICAL FIELD

Example embodiment of the present invention relates to an antenna and a transformer included in the same, more particularly relates to an antenna having an exchangeable transformer.

BACKGROUND ART

An antenna transmits/receives an electromagnetic wave by outputting a beam. It is needed that direction of the beam, i.e. tilting angle is adjusted in various directions. Accordingly, the antenna employs a phase shifter of dividing a power and a tilting adjustment apparatus, etc. so as to adjust the tilting angle.

Hereinafter, structure of common antenna will be described with reference to accompanying drawing.

FIG. 1 is a view illustrating schematically a common antenna.

In FIG. 1, the antenna includes a reflection plate 100, a phase shifter 102, a tilting adjustment apparatus 104 and a shaft 106.

The phase shifter 102 is connected electrically to radiators, divides the power into the radiators, and is formed on the reflection plate 100.

The phase shifter 102 includes a dielectric substrate 110, a line 112, a central axis member 114, an arm member 116 and a rotation member 118.

The tilting adjustment apparatus 104 is connected to the rotation member 118 of the phase shifter 102 through the shaft 106, and provides rotatory power to the rotation member 118 through the shaft 106 to rotate the rotation member 118 during adjustment of the tilting angle. Accordingly, the central axis member 114 connected to a center of the rotation member 118 rotates in response to rotation of the rotation member 118, and the arm member 116 rotates in response to rotation of the central axis member 114. As a result, amount of the power fed to the radiators connected to both ends of the line 112 changes, and so the direction of the beam outputted from the radiators is changed.

Distance of the arm member 116 shifted while the tilting adjustment apparatus 104 rotates by one time (hereinafter, referred to as "tilting angle adjustment rate) is constant. That is, the tilting angle adjustment rate of the antenna is not changed.

In case that a user means to use the antenna as another usage, e.g. in another frequency band, the tilting angle adjustment rate of the antenna need to be changed from initial setting. However, since one antenna may not change the tilting angle adjustment rate, the tilting adjustment apparatus 104 or the phase shifter 102 should be exchanged or the antenna should be replaced with another antenna. As a result, utilization of the antenna is lowered and exchanging cost increases.

DISCLOSURE

Technical Problem

Example embodiments of the present invention provide an antenna adjustable tilting angle adjustment rate to increase utilization of the antenna and a transformer included in the same.

Technical Solution

In one aspect, the prevent invention provides a transformer connected to a tilting adjustment apparatus comprising: a force delivering member; and a housing configured to cover the force delivering member. Here, a first thread is formed on an outer surface of the force delivering member, a second thread is formed on an inner surface of the housing, and the first thread is in gear with the second thread.

The force delivering member moves linearly in accordance with control of the tilting adjustment apparatus.

The tilting adjustment apparatus is connected to one side of the force delivering member, one side of a shaft is connected to another side of the force delivering member, and another side of the shaft is connected to an arm member, a guide member or a rotation member of a phase shifter.

The force delivering member locates between the tilting adjustment apparatus and the shaft, and is separable from the tilting adjustment apparatus and the shaft.

The number of line or pitch of the first thread differs according to tilting angle adjustment rate (change range of a tilting angle according as the tilting adjustment apparatus rotates by one time).

In another aspect, the present invention provides a transformer connected to a tilting adjustment apparatus comprising: a force delivering member; and a motion member connected to an element of a phase shifter, wherein a hole is formed to the motion member and the force delivering member is inserted into the hole of the motion member. Here, a first thread is formed on an outer surface of the force delivering member, a second thread is formed on an inner surface of the motion member, the first thread is in gear with the second thread, and the motion member moves in accordance with rotation of the force delivering member.

The force delivering member and the tilting adjustment apparatus are connected through a shaft, and the force delivering member is separable from the shaft.

The number of line or pitch of the first thread differs according to tilting angle adjustment rate (change range of a tilting angle according as the tilting adjustment apparatus rotates by one time).

In still another aspect, the prevent invention provides an antenna comprising: a phase shifter; a tilting adjustment apparatus; and a transformer configured to move linearly in response to a force provided from the tilting adjustment apparatus, and deliver a force corresponding to the moving to the phase shifter.

The antenna further includes a shaft configured to connect an arm member, a guide member or a rotation member of the phase shifter to the transformer. The transformer includes: a force delivering member; and a housing configured to cover the force delivering member. Here, a first thread is formed on an outer surface of the force delivering member, a second thread is formed on an inner surface of the housing, and the first thread is in gear with the second thread.

The antenna further includes a shaft connected between the tilting adjustment apparatus and the transformer. The transformer includes: a force delivering member; and a motion member connected to an element of a phase shifter, wherein a hole is formed to the motion member and the force delivering member is inserted into the hole of the motion member. A first thread is formed on an outer surface of the force delivering member, a second thread is formed on an inner surface of the motion member, the first thread is in gear with the second thread, and the motion member moves on the force delivering member in accordance with rotation of the force delivering member.

The force delivering member is separable from an element connected thereto.

The number of line or pitch of the first thread differs according to tilting angle adjustment rate (change range of a tilting angle according as the tilting adjustment apparatus rotates by one time).

The force delivering member is separable from an element connected thereto.

The number of line or pitch of the first thread differs according to tilting angle adjustment rate (change range of a tilting angle according as the tilting adjustment apparatus rotates by one time).

Advantageous Effects

A transformer of an antenna according to the present invention moves linearly in response to rotation of a tilting adjustment apparatus, and thus a user may realize various tilting angle adjustment rates using the transformer.

In addition, since the transformer is exchangeable, the tilting angle adjustment rate may be changed by exchanging only the transformer. Accordingly, utilization of the antenna is enhanced, and cost for realizing the antenna of which the tilting angle adjustment rate is changed may reduce.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
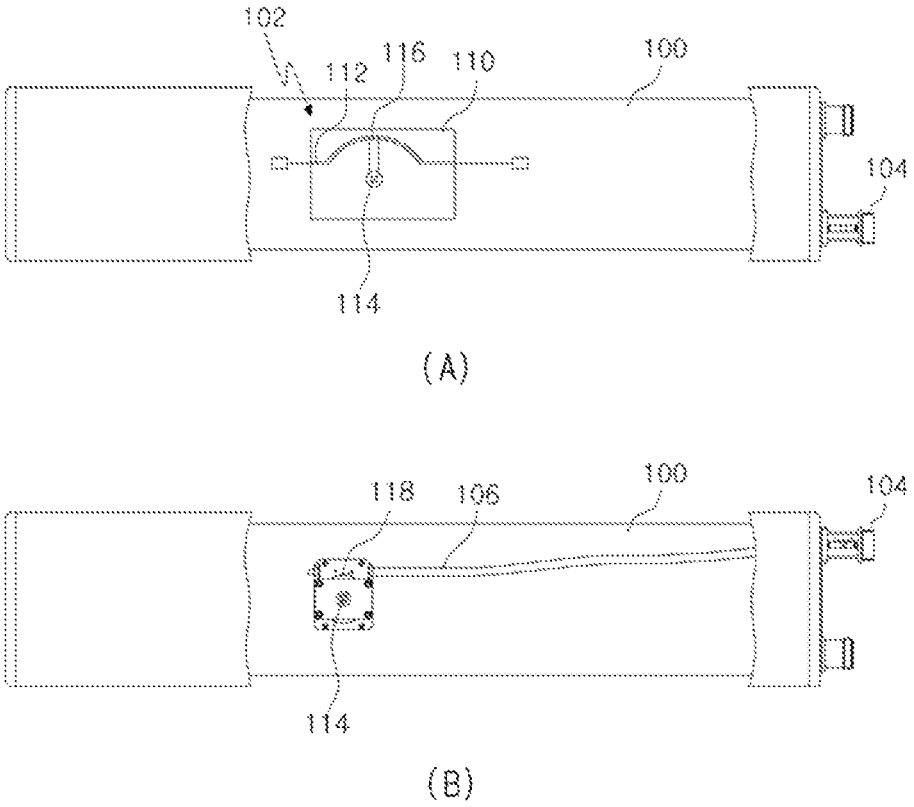
FIG. 1 RELATED ART
FIG. 1 is a view illustrating schematically a common antenna.
Figure 2:
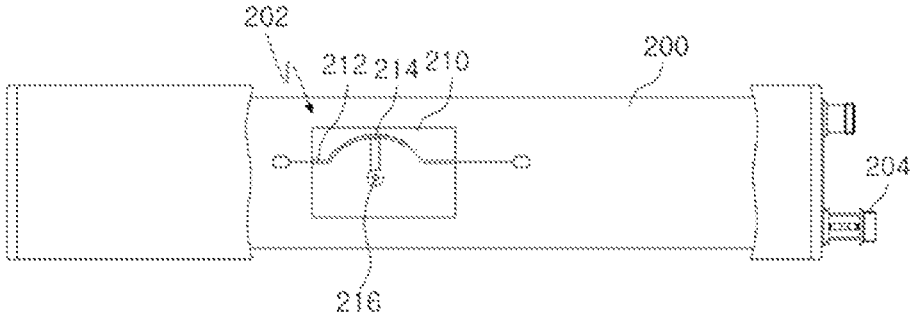
FIG. 2 is a view illustrating an antenna according to a first embodiment of the present invention.
Figure 2:
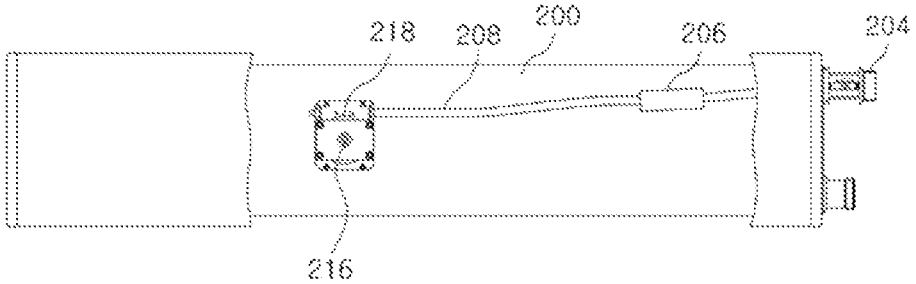

FIG. 2 is a view illustrating an antenna according to a first embodiment of the present invention.

In FIG. 2, an antenna of the present embodiment includes a reflector 200, a phase shifter 202, a tilting adjustment apparatus 204, a transformer 206 and a shaft 208.

The phase shifter 202 is disposed on the reflector 200, is connected electrically to at least one radiator (not shown), and divides a power inputted from outside into the radiators.

The phase shifter 202 changes amount of power fed to the radiators, thereby changing direction of a beam outputted from the radiators, i.e. tilting angle.

The phase shifter includes a dielectric substrate 210, a line 212, an arm member 214, a central axis member 216 and a rotation member 218. Here, the rotation member 218 locates on a surface opposed to a surface on which the dielectric substrate 210 is disposed of the reflector 200, and both ends of the line 212 are connected electrically to corresponding radiator.

In operation of the phase shifter 202, a power inputted through an input terminal (not shown) is divided into the radiators through a conducting line (not shown) formed on a lower surface of the arm member 214 and the line 212. Here, in case that the arm member 214 rotates, amount of the power delivered to respective radiators is changed, i.e. phase of RF signals is changed. As a result, tilting angle of a beam outputted from the radiators is changed.

The tilting adjustment apparatus 204 is an apparatus used for adjusting the tilting angle by a user at outside, and is connected to the transformer 206.

The transformer 206 moves linearly in response to a force delivered from the tilting adjustment apparatus 204 to shift the shaft 208, e.g. may be made up of multiple thread screw. In one embodiment of the present invention, the transformer 206 is connected between the tilting adjustment apparatus 204 and the shaft 208 and may be separable from the tilting adjustment apparatus 204 and the shaft 208. That is, the user may realize an antenna having different characteristics by exchanging only the transformer 206. This will be described below with reference to accompanying drawing.

The shaft 208 is connected to the transformer 206, and moves linearly according to control of the tilting adjustment apparatus 204. Here, various members may be employed as the shaft 208 as long as they deliver the force. The shaft 208 may be embodied with flexible material or be an inflexible bar. In another embodiment, the shaft 208 may not move linearly but move rotationally.

The shaft 208 is connected directly or indirectly to the rotation member 218 of the phase shifter 202, and thus the rotation member 218 rotates in accordance with shift of the shaft 208. Subsequently, the central axis member 216 combined with the rotation member 218 rotates in response to rotation of the rotation member 218, and so the arm member 214 rotates so that the tilting angle of the antenna is changed.

In another embodiment of the present invention, a guide member for fixing the arm member 214 is connected to the central axis member 216, and the guide member and the arm member 214 may rotate in response to rotation of the central axis member 216.

In a process of adjusting the tilting angle of the antenna, for example an electric motor (not shown) is inserted into a hole of side of the tilting adjustment apparatus 204, and the tilting adjustment apparatus 204 may rotate according to rotation of a rotation axis of the electric motor. In this case, since the shaft 208 is connected to the tilting adjustment apparatus 204 through the transformer 206, it moves linearly in response to rotation of the tilting adjustment apparatus 204. Then, the rotation member 218 and the central axis member 216 rotate in accordance with shift of the shaft 208, and so the arm member 214 moves. As a result, the tilting angle of the antenna is adjusted.

Hereinafter, structure and operation of the transformer 206 will be described in detail with reference to accompanying drawing.

Figure 3:
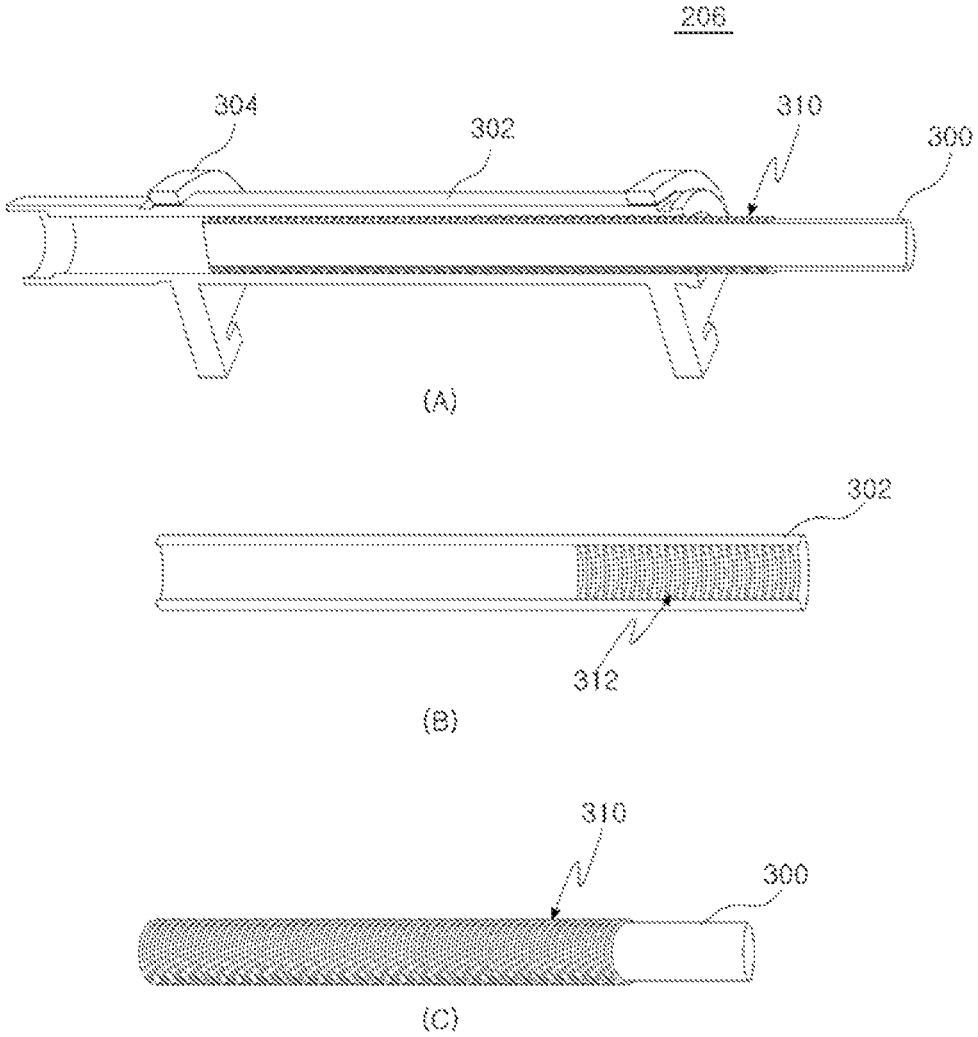
FIG. 3 is a sectional view illustrating structure of a transformer according to one embodiment of the present invention.

FIG. 3 is a sectional view illustrating structure of a transformer according to one embodiment of the present invention.

In FIG. 3(A), the transformer 206 includes a force delivering member 300 and a housing 302.

The force delivering member 300 is connected to an adapter of the tilting adjustment apparatus 204, and a first thread 310 is formed on an outer surface of the force delivering member 300 as shown in FIG. 3(C). For example, the force delivering member 300 is a multiple thread screw. Here, the adapter means a part projecting from a center of the tilting adjustment apparatus 204, and is combined with the force delivering member 300.

The housing 302 covers the force delivering member 300, and a second thread 312 is formed on an inner surface of the housing 302 as shown in FIG. 3(B).

In other words, the first thread 310 is in gear with the second thread 312 as shown in FIG. 3(A), and so the force delivering member 300 moves linearly according to rotation of the tilting adjustment apparatus 204.

On the other hand, shift distance of the force delivering member 300 differs depending on number of lines of the first thread 310. For example, in case that the force delivering member 300 is a double screw thread, the force delivering member 300 shifts by 2 pitch according as the tilting adjustment apparatus 206 rotates by one time. In case that the force delivering member is a quadruple screw thread, the force delivering member 300 shifts by 4 pitch according as the tilting adjustment apparatus 206 rotates by one time. Accordingly, a user may employ the force delivering member 300 having proper lines considering tilting angle adjustment rate (range of tilting angle changed while the tilting adjustment apparatus 206 rotates by one time).

Now referring to FIG. 3(A), the housing 302 may combine stably with the reflector 200 by a fixing member 304.

In brief, the antenna of the present embodiment uses exchangeable transformer 206.

In case that the user mean to change the tilting angle adjustment rate in the conventional antenna, many components such as a phase shifter, a tilting adjustment apparatus, etc. should be exchanged or another antenna having the changed rate should be used instead of the antenna. As a result, cost for realizing the antenna having different tilting angle adjustment rate increases and utilization of the antenna is lowered.

Whereas, the antenna of the present invention may realize the antenna having desired tilting angle adjustment rate by exchanging only the transformer 206. Accordingly, utilization of the antenna of the present invention increases compared to that of the conventional antenna and an assembling process may simplify. In addition, cost for realizing an antenna having different tilting angle adjustment rate may reduce.

Figure 4:
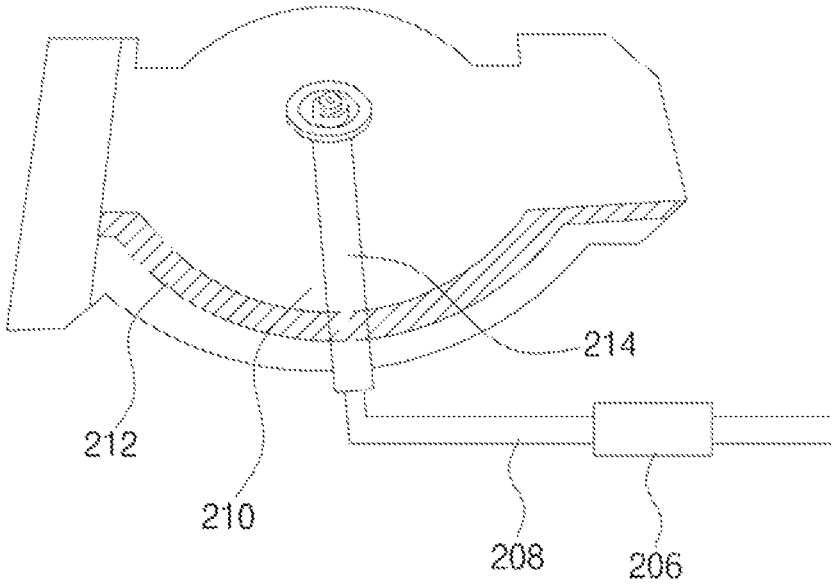
FIG. 4 is a view illustrating schematically an antenna according to a second embodiment of the present invention.

FIG. 4 is a view illustrating schematically an antenna according to a second embodiment of the present invention.

In FIG. 4, the antenna of the present invention includes a phase shifter having a dielectric substrate 210, a line 212 and an arm member 214, a tilting adjustment apparatus 204, a transformer 206 and a shaft 208.

Unlike the first embodiment in which the shaft 208 is connected to the central axis member 216 through the rotation member 218, the shaft 208 is connected directly to the arm member 214 or a guide member in the present embodiment. As a result, rotatory power of the tilting adjustment apparatus 204 is delivered directly to the arm member 214 through the shaft 208 unlike the first embodiment in which rotator power of the tilting adjustment apparatus 204 is delivered indirectly to the arm member 214 through the rotation member 218 and the central axis member 216. Hence, loss of the power in a process of delivering the rotatory power to the arm member 214 may reduce compared to in the first embodiment.

In the first embodiment, many components such as the rotation member 218, etc. exist on a rear side of the reflector 200 in the phase shifter 202. However, in the phase shifter in the antenna of the present embodiment, any member does not exist on a rear side of the reflector 200. Accordingly, the phase shifter in the antenna of the present embodiment may be embodied with simple structure and characteristics of the antenna such as isolation, PIMD, etc. may be enhanced.

In the antenna of the present embodiment, the transformer 206 is also connected between the tilting adjustment apparatus 204 and the shaft 208, and moves linearly. Accordingly, the user may select and use the transformer 206 corresponding to desired tilting angle adjustment rate.

Figure 5:
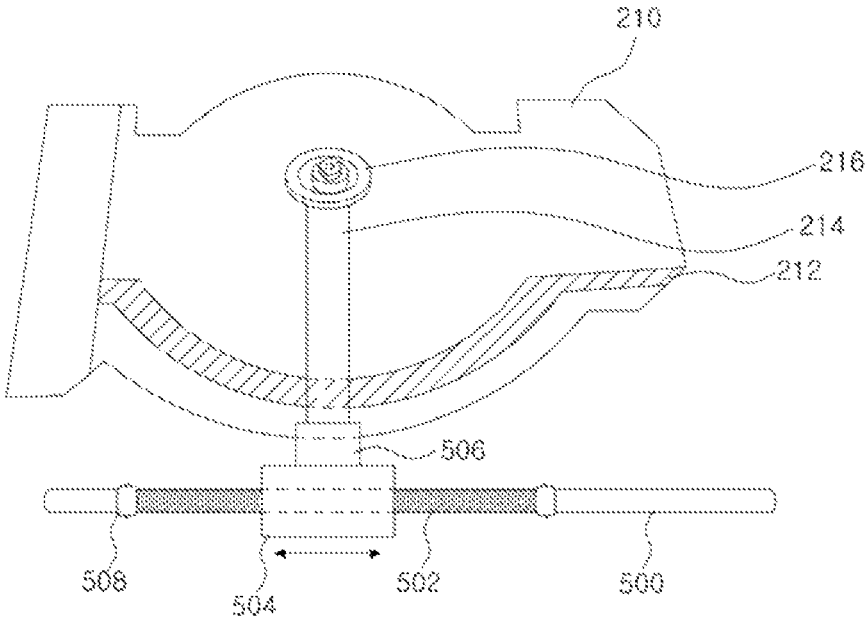
FIG. 5 is a view illustrating schematically an antenna according to a third embodiment of the present invention.

FIG. 5 is a view illustrating schematically an antenna according to a third embodiment of the present invention.

In FIG. 5, the antenna of the present embodiment includes a phase shifter having a dielectric substrate 210, a line 212, an arm member 214 and a central axis member 216, a shaft 500, a transformer having a force delivering member 502 and a motion member 504, and a connection member 506.

The transformer of the present embodiment uses the motion member 504 instead of the housing member 302 unlike the above embodiments. The transformer is exchangeable.

Unlike the above embodiments in which the force delivering member 300 shifts left and right or the front and the rear, the force delivering member 502 is fixed to the reflector 200 by the fixing member 508, and the motion member 504 shifts left and right or the front and the rear as shown in FIG. 5.

That is, in case that the tilting adjustment apparatus 204 rotates the shaft 500, the motion member 504 moves on the force delivering member 502 under the condition that the force delivering member 502 is fixed. Particularly, the force delivering member 502 is disposed through the motion member 504, a fourth thread formed on inner surface of the motion member 504 is in gear with a third thread formed on an outer surface of the force delivering member 502. Since the force delivering member 502 is fixed, the motion member 504 moves.

In this case, since the motion member 504 is connected to the arm member 214 through the connection member 506, the arm member 216 moves according as the motion member 504 moves, and so the tilting angle of the antenna is adjusted.

In short, in the antenna of the present embodiment, the transformer controls directly the arm member 214, and the motion member 504 moves linearly in response to rotation of the shaft 500 under the condition that the force delivering member 502 is fixed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A transformer connected to a tilting adjustment apparatus comprising:

a force delivering member; and a motion member connected to an element of a phase shifter, wherein a hole is formed to the motion member and the force delivering member is inserted into the hole of the motion member, wherein a first thread is formed on an outer surface of the force delivering member, a second thread is formed on an inner surface of the motion member, the first thread is in gear with the second thread, the motion member moves in accordance with rotation of the force delivering member, the force delivering member and the tilting adjustment apparatus are connected through a shaft, and the force delivering member is separable from the shaft.

2. The transformer of claim 1, wherein the tilting adjustment apparatus is connected to one side of the force delivering member, one side of the shaft is connected to another side of the force delivering member, and another side of the shaft is connected to an arm member, a guide member or a rotation member of the phase shifter.

3. The transformer of claim 1, wherein the number of line or pitch of the first thread differs according to tilting angle adjustment rate (change range of a tilting angle according as the tilting adjustment apparatus rotates by one time).

4. An antenna comprising:

a phase shifter;

a tilting adjustment apparatus; and a transformer configured to move linearly in response to a force provided from the tilting adjustment apparatus, and deliver a force corresponding to moving the transformer to the phase shifter, wherein the transformer includes:

a force delivering member; and a motion member connected to an element to the phase shifter, wherein a hole in formed in the motion member and the force delivering member is inserted into the hole of the motion member, wherein a first thread is formed on an outer surface of the force delivering member, a second thread is formed on an inner surface of the motion member, the first thread is in gear with the second thread, the motion member moves in accordance with rotation of the force delivering member, the force delivering member and the tilting adjustment apparatus are connected through a shaft, and the force delivering member is separable from the shaft.

5. The antenna of claim 4, wherein:

the shaft is connected to an arm member, a guide member or a rotation member of the phase shifter, and the transformer further includes:

a housing configured to cover the force delivering member.

6. The antenna of claim 4, wherein the number of line or pitch of the first thread differs according to tilting angle adjustment rate (change range of a tilting angle according as the tilting adjustment apparatus rotates by one time).

* * * * *